US006634785B2

(12) United States Patent
French et al.

(10) Patent No.: US 6,634,785 B2
(45) Date of Patent: Oct. 21, 2003

(54) MIXER ASSEMBLY

(76) Inventors: Ronald French, 7128 Granger Dr., Howell, MI (US) 48843; Richard French, 10920 Stallings Rd., Spring Hope, NC (US) 27882

( * ) Notice: Subject to any disclaimer, the term of this patent is extended or adjusted under 35 U.S.C. 154(b) by 54 days.

(21) Appl. No.: 10/002,814

(22) Filed: Nov. 2, 2001

(65) Prior Publication Data

US 2002/0054539 A1 May 9, 2002

Related U.S. Application Data

(60) Provisional application No. 60/245,762, filed on Nov. 3, 2000.

(51) Int. Cl.[7] ..... B01F 15/00
(52) U.S. Cl. ..... 366/347; 366/605
(58) Field of Search ..... 366/347, 605; 220/254.1, 283, 820

(56) References Cited

U.S. PATENT DOCUMENTS

| | | | | | |
|---|---|---|---|---|---|
| 793,844 | A | * | 7/1905 | Libbman | 366/331 |
| 975,336 | A | * | 11/1910 | Doherty | 366/347 |
| 1,328,652 | A | * | 1/1920 | Ehlers | 366/347 |
| 2,662,754 | A | * | 12/1953 | Sharp | 366/347 |
| 2,681,211 | A | * | 6/1954 | Reynolds | 366/347 |
| 2,802,499 | A | * | 8/1957 | Tupper | 366/347 |
| 2,858,118 | A | * | 10/1958 | Perkins | 366/347 |
| 3,162,338 | A | * | 12/1964 | Grubelic | 366/347 |
| 3,417,972 | A | * | 12/1968 | Vincent | 366/242 |
| 3,704,007 | A | * | 11/1972 | Kroeger | 366/248 |
| 4,422,770 | A | * | 12/1983 | Geible | 366/605 |
| 4,561,782 | A | * | 12/1985 | Jacobsen et al. | 366/347 |
| 5,251,979 | A | * | 10/1993 | Larsen | 366/279 |
| 5,368,388 | A | * | 11/1994 | Fillon | 366/605 |
| 5,437,400 | A | * | 8/1995 | Loeffler | 366/343 |

* cited by examiner

*Primary Examiner*—Tony G. Soohoo
(74) *Attorney, Agent, or Firm*—Gifford, Krass, Groh, Sprinkle, Anderson & Citkowski, P.C.

(57) ABSTRACT

A mixer assembly is disclosed having a container with a closed sidewall, a closed bottom and a rim which forms an open top. The container is adapted to contain a product, such as roofing sealant, plaster or the like, to be mixed. A cover overlies the open top while a clamp detachably secures the cover to the container rim. A tubular conduit is attached to the cover so that the opposite ends of the conduit are open to the opposite sides of the cover. A stirrer assembly having a driven shaft and an agitator secured to one end of the shaft is then positioned within the container so that the agitator is solely contained within the container while the shaft extends exteriorly through the conduit and above the cover. A rotary drive, such as a drill, is then secured to the upper end of the shaft to rotatably drive the agitator and mix the product within the container.

5 Claims, 2 Drawing Sheets

MIXER ASSEMBLY

RELATED APPLICATION

This application claims priority of U.S. Provisional Patent Application No. 60/245,762 filed Nov. 3, 2000 and is incorporated herein by reference.

BACKGROUND OF THE INVENTION

I. Field of the Invention

The present invention relates generally to mixer assemblies.

II. Description of the Prior Art

Many types of commercial product, such as plaster, roofing sealant, paint, cementitious material and the like, are typically sold in containers having a closed sidewall, a closed bottom and an upper rim which forms an open top. A cover is then detachably secured to the container rim, which enables shipment of the product.

When use of the product is desired, the cover is typically removed and, in many cases, the product must be stirred prior to use. Conventionally, a stirrer assembly having an elongated shaft with an agitator at one end is used to stir the product. With the top removed, the agitator is positioned within the interior of the container while a rotary drive, such as a drill, is secured to the free end of the drive shaft. As the agitator is rotatably driven by the rotary drive, the product within the container is mixed as desired.

One disadvantage of this previously known method for stirring such commercial product is that, with the cover removed, a small portion of the product is flung from the container by the agitator during the stirring process. This not only wastes product, but also creates a mess for the workman.

SUMMARY OF THE PRESENT INVENTION

The present invention provides a mixer assembly which overcomes all of the above-mentioned disadvantages of the previously known devices.

In brief, the mixer assembly of the present invention comprises a container in which the product to be mixed is contained. Preferably, this mixing container is the same container in which the product was shipped.

A cover is adapted to overlie the open top of the container while a clamp assembly detachably secures the cover to the upper rim of the container. Additionally, this cover includes a tubular conduit attached to the cover so that the opposite ends of the conduit are open to the opposite sides of the cover. Preferably, this tubular conduit is positioned substantially centrally on the cover.

The mixer assembly of the present invention is utilized with the conventional stirrer assembly having an elongated driven shaft and an agitator mounted at one end of the shaft. With the agitator positioned within the interior of the container, the cover is detachably secured across the open top of the container so that the stirrer assembly shaft protrudes through the conduit so that the free end of the shaft is positioned above the cover. A rotary drive, such as a drill, is then secured to the upper free end of the shaft so that, upon activation of the rotary drive, the agitator is rotatably driven thus mixing the product within the container. Furthermore, the diameter of the conduit is preferably several times the diameter of the drive shaft so that the drive shaft can be skewed relative to the conduit to enable complete mixing of the product within the container.

A primary advantage of the mixer assembly of the present invention is that the cover and conduit prevents the product from being flung or expelled from the container during the mixing process. This not only conserves product, but also minimizes the amount of mess created during the mixing process.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
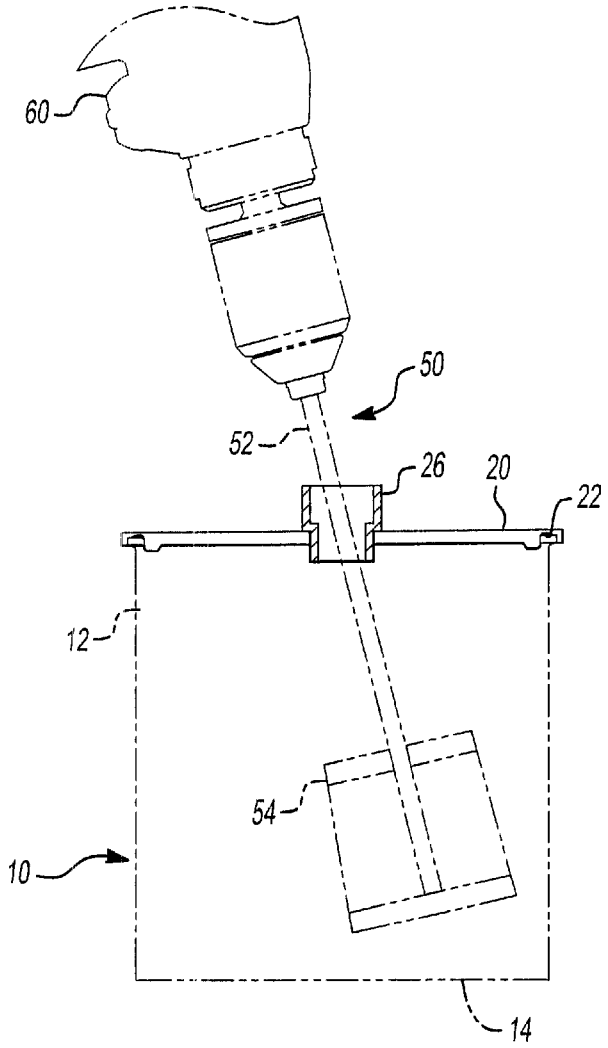
FIG. 1 is a side sectional view illustrating a preferred embodiment of the present invention.

With reference first to FIG. 1, a container 10 of the type utilized to contain commercial product, such as roofing sealant, plaster, paint, cementitious material or the like, is shown. The container 10 includes a closed and generally circular sidewall 12 and a closed bottom 14. The container 10 has an upper rim 16 which forms an open top for the container 10. The container 10, furthermore, is of the type used for commercial products and, as such, is typically five or ten gallons in size.

Figure 2:
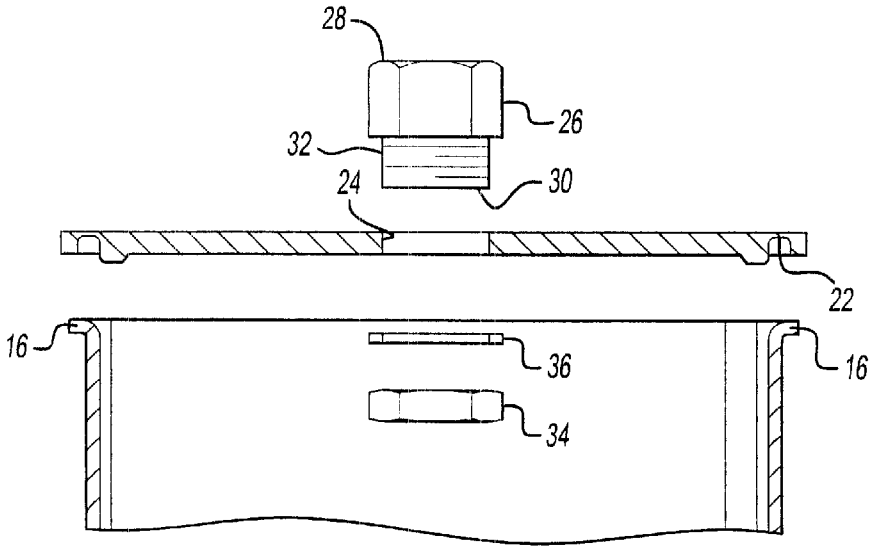
FIG. 2 is an exploded view illustrating a portion of the preferred embodiment of the present invention.

With reference now to FIGS. 1 and 2, the mixer assembly of the present invention includes a generally circular cover 20 dimensioned to overlie and cover the open top of the container 10. The cover 20 thus includes an outer rim 22 which is dimensioned to fit over and receive the upper rim 16 of the container 10.

Referring now particularly to FIG. 2, the cover 20 includes a through opening 24 which is preferably centrally located on the cover 20. A tubular conduit 26 is then detachably secured to the cover 20 through the opening 24 so that the opposite ends 28 and 30 of the conduit 26 are open to the opposite sides of the cover 20.

Although any conventional means may be utilized to secure the conduit 26 to the cover 20, as illustrated in FIG. 2, the conduit 26 includes a lower threaded end 32 which is positioned through the cover opening 24. A nut 34 and washer 36 are then positioned over the threaded end 32 of the conduit 26 so that, upon tightening of the nut 34, the nut 34 secures the conduit 26 to the cover 20.

Alternatively, however, the cover 20 and conduit 26 may be of a one-piece construction.

Figure 3:
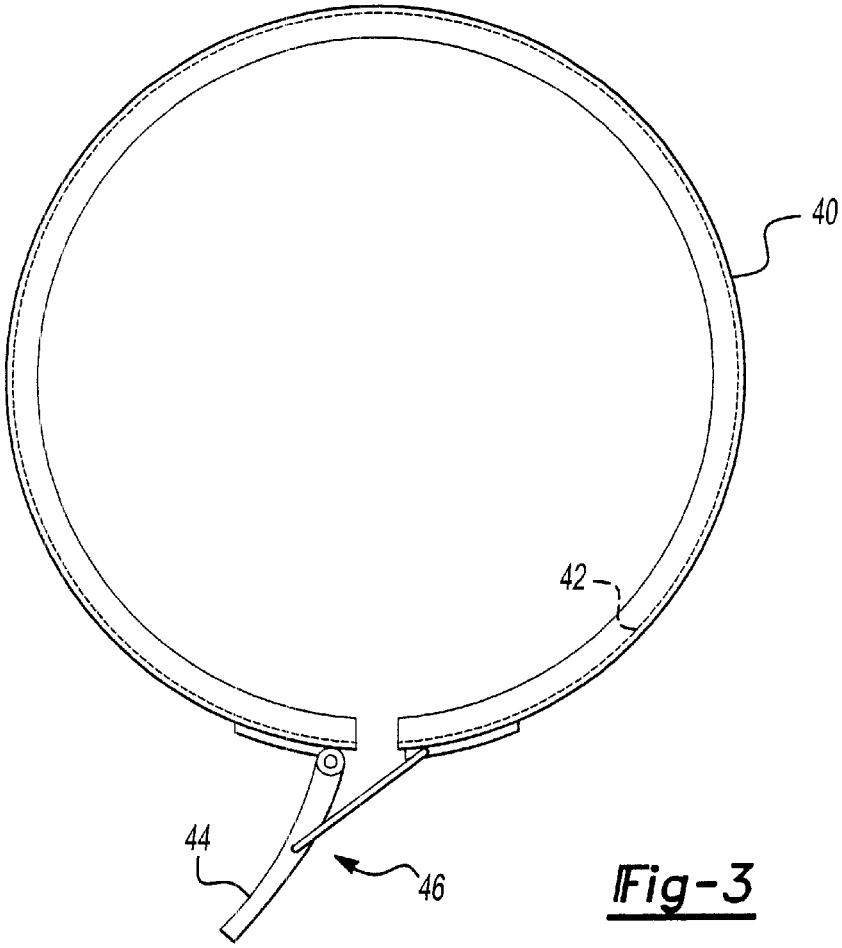
FIG. 3 is a view illustrating a clamp utilized in conjunction with the preferred embodiment of the present invention and illustrating the clamp in an open position.
Figure 4:
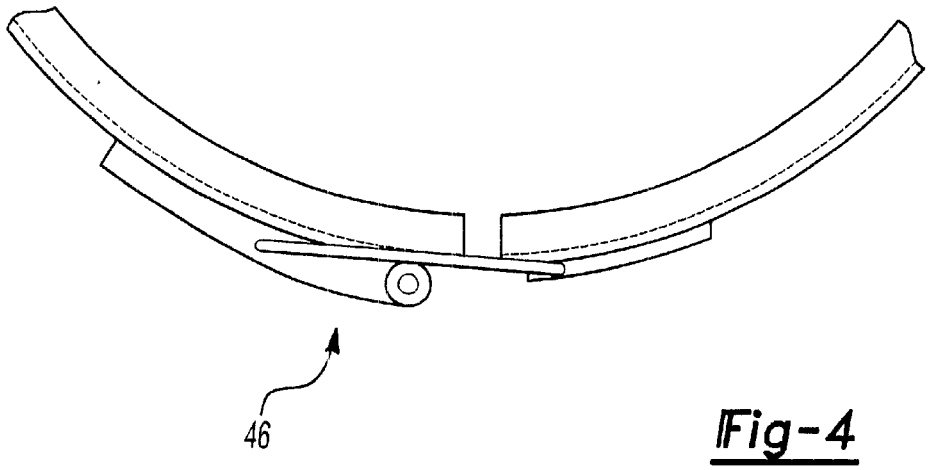
FIG. 4 is a fragmentary view of the clamp illustrating the clamp in a closed position.

With reference now to FIGS. 3 and 4, a clamp 40 is provided for detachably securing the cover 20 to the container 10. The clamp 40 is generally circular in shape and includes a generally inwardly facing U-shaped channel 42. With the cover 20 positioned over the container rim 16 as illustrated in FIG. 1, the clamp 40, when in an open position (FIG. 3), is dimensioned to fit around both the cover rim 22 and container rim 16 so that the rims 16 and 22 of the container 10 and cover 20, respectively, are positioned within the clamp channel 42. In doing so, the clamp 40 abuts against the oppositely faced edges of the cover 20 and container rim 16.

Still referring to FIGS. 3 and 4, an over center latch 44 is movable between an open position, illustrated at 46 in FIG. 3, and a clamp position, illustrated at 48 in FIG. 4. In its unclamped position 46, the diameter of the clamp 40 is greater than the diameter of the cover 20 so that the clamp 40 can be positioned around the rims 16 and 22 of the container 10 and cover 20, respectively. When the clamp 40 is moved to its clamped position 48, the latch 44 effectively reduces the overall length of the clamp 40 so that both the cover rim 22 and container rim 16 are nested within the clamp channel 42 thus securely, but detachably, securing the cover 20 to the container 10.

With reference again to FIG. 1, the cover 20 is intended for use with a conventional stirrer assembly 50 having an elongated drive shaft 52 and an agitator 54 secured to one end of the drive shaft 52. With the agitator 54 positioned within the interior of the container 10, and thus within the product to be mixed, the cover 20 is detachably secured to the container 10 by the clamp 40 so that the shaft 52 extends through the conduit 26. A rotary drive mechanism, such as a drill 60, is then detachably secured to the upper or free end of the shaft 52 so that, upon activation, the rotary drive mechanism rotatably drives the agitator 54 thus mixing the product in the container 10 in the desired fashion.

Furthermore, as best shown in FIG. 1, the inside diameter of the conduit 26 is preferably several times the outside diameter of the shaft 52. This enables the agitator 54 to be skewed relative to the conduit 26 which, in turn, enables the agitator 54 to reach essentially all of the areas within the container 10 to ensure complete mixing of the product.

After the product has been mixed, the clamp 40 is moved to its unclamped position and removed from the container 10 together with the cover 20. The cover 20 can then be reused together with the clamp 40 as often as needed.

From the foregoing, it can be seen that the present invention provides a simple and yet highly effective mixing assembly for use with a conventional container which minimizes product waste and mess during the mixing operation. Having described my invention, however, many modifications thereto will become apparent to those skilled in the art to which it pertains without deviation from the spirit of the invention as defined by the scope of the appended claims.

We claim:

1. A mixer assembly comprising:

a container having a closed sidewall, a closed bottom and a rim forming an open top, said container adapted to contain a product to be mixed, a cover adapted to overlie said open top of said container, means for detachably securing said cover to said container rim, a tubular conduit attached to said cover so that opposite ends of said conduit are open to opposite sides of said cover, a stirrer assembly having a driven shaft and an agitator secured to one end of said shaft, said shaft extending through said conduit when said agitator is positioned in said container, wherein said clamp is elongated and circular in shape, and comprising means for adjusting the length of said clamp between a clamped position in which said clamp engages said oppositely facing edges of said cover and said rim, and an unclamped position in which said clamp has a diameter greater than the diameter of said cover and said rim.

2. The invention as defined in claim 1 wherein said conduit is circular in cross sectional shape.

3. The invention as defined in claim 1 and comprising means for detachably securing said conduit to said cover.

4. The invention as defined in claim 1 wherein said means for detachably securing said cover to said container comprises an elongated clamp dimensioned to engage oppositely facing edges of said cover and said rim.

5. The invention as defined in claim 1 wherein said adjusting means comprises an over center latch.

* * * * *